US007222724B2

(12) United States Patent
Friessnegg et al.

(10) Patent No.: US 7,222,724 B2
(45) Date of Patent: May 29, 2007

(54) APPARATUS FOR TRANSPORTING FLAT WORK PIECES

(75) Inventors: Robert Friessnegg, Lauffen/N (DE); Udo Ganter, Freiberg am Neckar (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 34 days.

(21) Appl. No.: 11/093,462

(22) Filed: Mar. 30, 2005

(65) Prior Publication Data

US 2005/0217979 A1 Oct. 6, 2005

(30) Foreign Application Priority Data

Mar. 30, 2004 (DE) ..... 10 2004 015 592

(51) Int. Cl.
*B65G 15/00* (2006.01)
*B65H 5/02* (2006.01)

(52) U.S. Cl. ..... 198/626.3; 198/626.5; 271/272

(58) Field of Classification Search .. 198/626.1–626.6; 271/302, 272
See application file for complete search history.

(56) References Cited

U.S. PATENT DOCUMENTS 815,008 A * 3/1906 Davidson ..... 271/201
2,815,949 A * 12/1957 Faeber ..... 271/302
4,585,432 A * 4/1986 Marysse ..... 493/59
5,106,077 A * 4/1992 Kawaguchi et al. ..... 271/302
5,433,430 A 7/1995 Straessler et al.
5,492,216 A * 2/1996 McCoy et al. ..... 198/626.5
6,296,107 B1 * 10/2001 Baumgartner-Pichelsberger ..... 198/626.6
6,772,649 B2 * 8/2004 Zimmermann et al. .. 73/863.11

FOREIGN PATENT DOCUMENTS

| | | |
|---|---|---|
| DE | 948 139 | 8/1956 |
| DE | 21 31 258 | 2/1972 |
| DE | 27 21 137 A1 | 1/1978 |
| DE | 26 43 906 A1 | 3/1978 |
| DE | 0 130 852 A1 | 1/1985 |
| DE | 38 27 108 A1 | 2/1990 |
| WO | WO 94/13567 | 6/1994 |

* cited by examiner

*Primary Examiner*—Mark A. Deuble
(74) *Attorney, Agent, or Firm*—Laurence A. Greenberg; Werner H. Stemer; Ralph E. Locher

(57) ABSTRACT

An apparatus for transporting flat work pieces has a first conveyor and a second conveyor. An inlet mouth is formed from the first conveyor and the second conveyor. The apparatus is distinguished by a geometry of the inlet mouth which can be optimized with regard to different, jointly assumed pivoting positions of the conveyors.

9 Claims, 5 Drawing Sheets

APPARATUS FOR TRANSPORTING FLAT WORK PIECES

BACKGROUND OF THE INVENTION

Field of the Invention

The invention relates to an apparatus for transporting flat work pieces in a transport direction. The apparatus has a first conveyor which makes contact with a first surface of a respective one of the work pieces, a second conveyor which makes contact with a second surface, lying opposite the first surface, of a respective one of the work pieces, and an inlet mouth which is formed by the two conveyors and has a mouth lower part and a mouth upper part.

An apparatus of this type is, inter alia, a constituent part of a standing sheet deliverer, which has been marketed by the applicant under the type designation SBP. The flat work pieces which are transported in a conveying direction are, for example, brochures which are received by a processing station which is situated upstream with regard to the transport direction, such as a preceding station in the form of a folding machine or a gathering and stitching machine etc., and are transferred to a further processing station which is situated downstream, such as a press station.

Different types of the abovementioned preceding stations also have, in particular, different outlet heights. As the brochures are to be output at an ergonomically favorable level by the apparatus which transports them, the known apparatus is disposed pivotably, in such a way that the inlet height of the apparatus can be adapted to different outlet heights of different preceding stations while substantially maintaining the outlet height of the apparatus.

The conveyors of the known apparatus are configured as flexible drives. Accordingly, the apparatus contains side walls and axles and shafts mounted in the latter for guide rollers and drive rollers for flexible drive devices which are configured in the form of endless round belts and form conveying runs which face one another and extend from an inlet mouth to an outlet mouth. The inlet mouth and the outlet mouth have a fixed geometry. In order to counteract the entry behavior of the flat work pieces which is impaired as a result of specific pivoting positions of the flexible drive conveyor, the length of the latter is dimensioned in such a way that, even in the case of a relatively small pivoting range, the inlet mouth can be raised and lowered within a sufficiently large range.

SUMMARY OF THE INVENTION

It is accordingly an object of the invention to provide an apparatus for transporting flat work pieces which overcomes the above-mentioned disadvantages of the prior art devices of this general type, which, even given an overall length which is shortened compared with the prior art devices mentioned in the introduction, the result is a favorable entry behavior of the flat work pieces into the apparatus.

With the foregoing and other objects in view there is provided, in accordance with the invention, an apparatus for transporting flat work pieces in a transport direction. The apparatus contains a first conveyor for making contact with a first surface of a respective one of the work pieces; and a second conveyor for making contact with a second surface, lying opposite the first surface, of the respective one of the work pieces. The first and second conveyors form an inlet mouth having a mouth upper part and a mouth lower part. The inlet mouth has a geometry which can be changed such that, in a first case, the mouth lower part protrudes beyond the mouth upper part and, in a second case, the mouth upper part protrudes beyond the mouth lower part.

In order to achieve the object, a geometry of the inlet mouth is provided which can be changed in such a way that, in a first case, the mouth lower part protrudes beyond the mouth upper part and, in a second case, the mouth upper part protrudes beyond the mouth lower part.

One advantageous development provides for it to be possible, for adaptation to different thicknesses of the flat work pieces, to set different spacings between the two conveyors. This is advantageous, for example if the conveyors are configured as flexible drives, in particular if rollers for driving and guiding a first flexible drive stand directly opposite those of the second flexible drive.

A configuration of this type exists, for example, if one of the two flexible drives is approximately a mirror image of the other and both are not displaced with respect to one another, as can certainly be provided if the conveyors are oriented horizontally. To this extent, the capability to be set to different thicknesses of the flat work pieces increases the area of application of the apparatus, in particular if it is equipped with displaceably disposed conveyors.

Other features which are considered as characteristic for the invention are set forth in the appended claims.

Although the invention is illustrated and described herein as embodied in an apparatus for transporting flat work pieces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
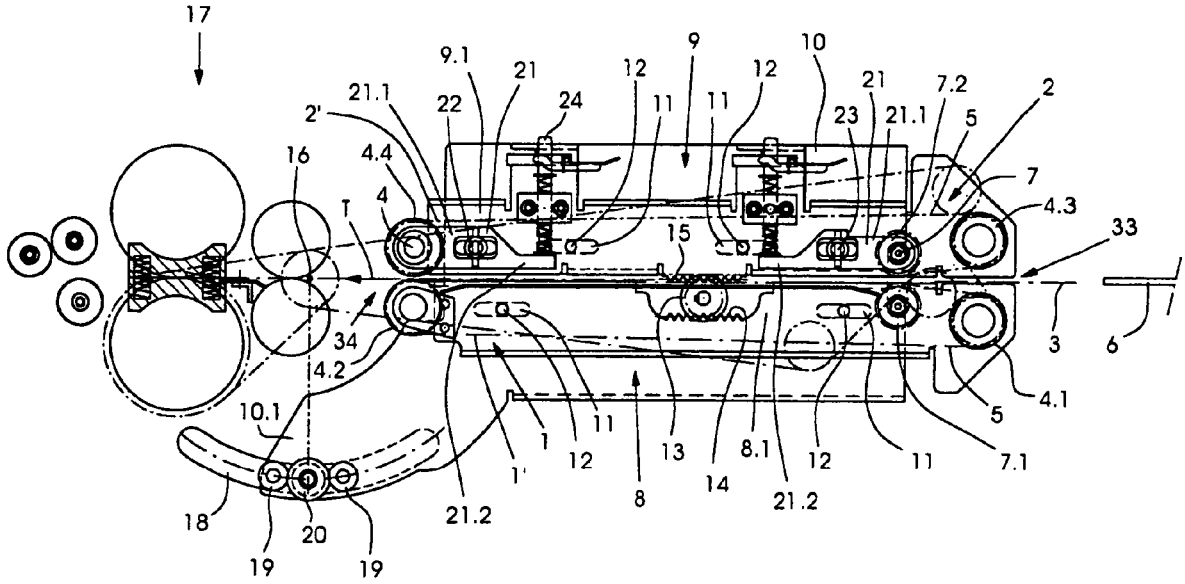
FIG. 1 is a diagrammatic, side-elevational view of, inter alia, an exemplary embodiment of an apparatus for transporting flat work pieces, conveyors being provided in the form of flexible drives which, in the case shown, are oriented horizontally and according to the invention.

Referring now to the figures of the drawing in detail and first, particularly, to FIG. 1 thereof, there is shown an exemplary embodiment which is described in the following text, and has a first conveyor 1 formed by a first flexible drive 1' and a second conveyor 2 formed by a second flexible drive 2'. The flexible drives 1', 2' substantially have a geometry that is mirrored along a conveying plane 3, and they contain, at a respective first end and at a respective second end, a multiplicity of deflection rollers 4.1 to 4.4 which are wrapped around by endless belts 5. The belts 5 of the first flexible drive 1' form first conveying runs which face second conveying runs formed by the belts 5 of the second flexible drive 2', and the first conveying runs make operating contact with a first surface of a flat work piece 6 which is to be conveyed. The second conveying runs make operative contact with a second surface, lying opposite the first surface, of the flat work piece 6 that is to be conveyed in a transport direction according to arrow T. In the present exemplary embodiment, the conveying runs extend from the deflection rollers 4.2 and 4.4 which are disposed downstream with regard to the transport direction according to arrow T to flexible drive guide rollers 7.1 and 7.2 which follow at a defined spacing downstream of the deflection rollers 4.1 and 4.3 which are disposed at the upstream end of the respective flexible drive and for their part are disposed at a defined spacing from the conveying plane 3.

In the configuration shown in FIG. 1, the deflection rollers 4.1 and 4.2 and the flexible drive guide rollers 7.1 of the first flexible drive 1' lie directly opposite the deflection rollers 4.3 and 4.4 and the flexible drive guide roller 7.2 of the second flexible drive 2'. This proves suitable for the case where the conveying runs, as shown in FIG. 1, are oriented horizontally.

It goes without saying that the two flexible drives 1' and 2' each have a multiplicity of the abovementioned belts 5 and a corresponding number of deflection rollers 4.1 to 4.4 and flexible drive guide rollers 7.1 and 7.2 which are disposed in a row transversely with respect to the transport direction according to arrow T between side cheeks 8.1 and 9.1 of two carriages 8 and 9 which will be described in greater detail in the following text.

Figure 2:
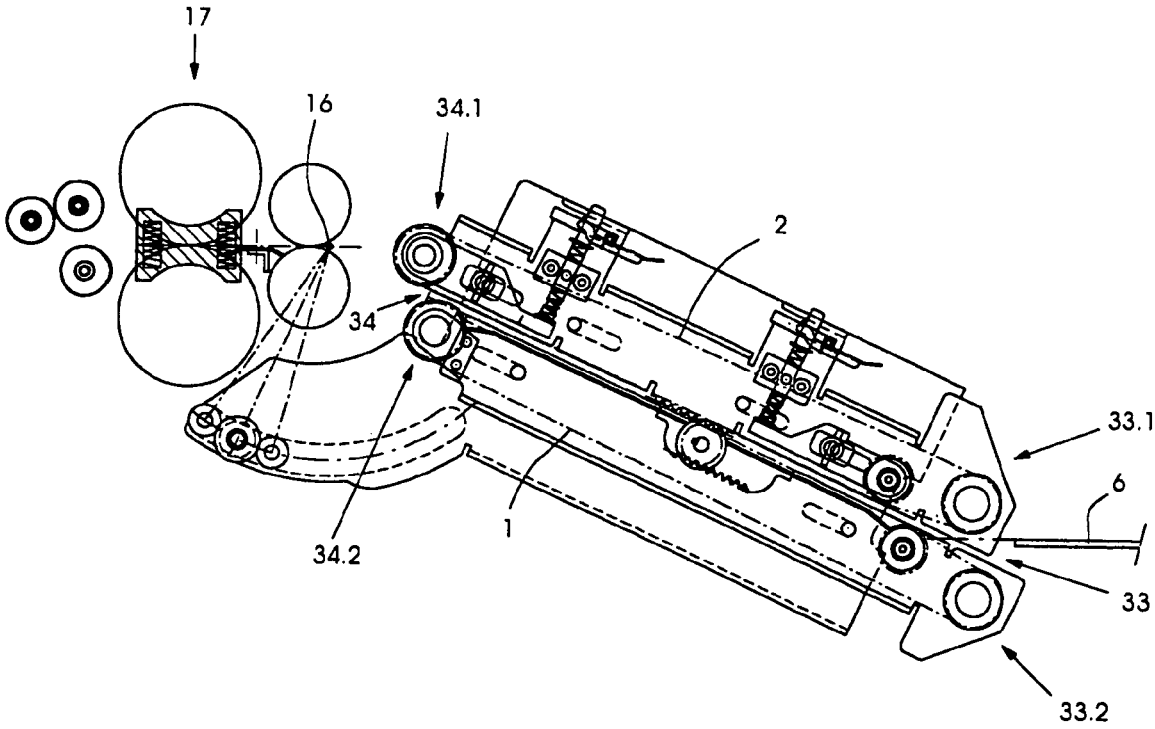
FIG. 2 is a diagrammatic, side-elevational view of the subject matter according to FIG. 1, with the flexible drives, which are displaced with respect to one another and are inclined in a first direction.
Figure 3:
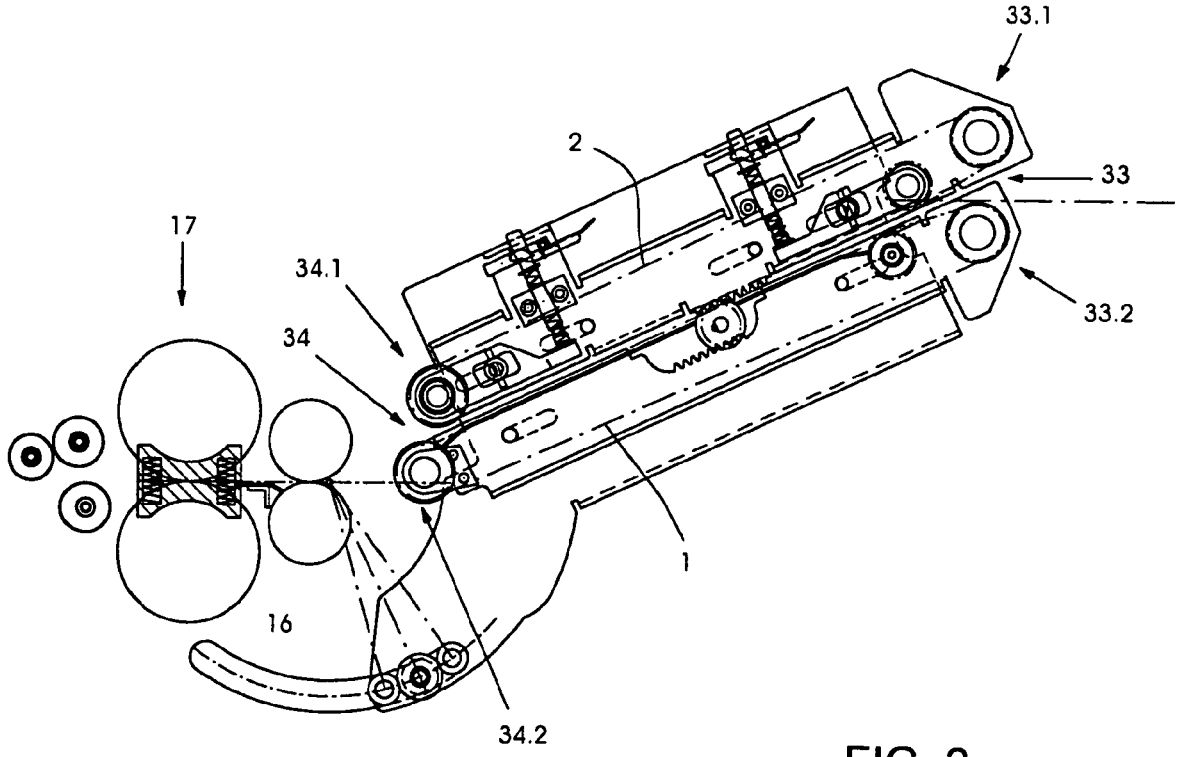
FIG. 3 is a diagrammatic, side-elevational view of the subject matter according to FIG. 1, with the flexible drives, which are displaced with respect to one another and are inclined in a second direction.

As shown in FIG. 2, for the case where the downstream ends of the flexible drives 1' and 2' are lowered, the second flexible drive 2' is preferably displaced, with respect to the first flexible drive 1', in the transport direction according to arrow T. As shown in FIG. 3, for the case where the upstream ends of the flexible drives 1' and 2' are raised, the second flexible drive 2' is in contrast preferably displaced, with respect to the first flexible drive 1', counter to the transport direction according to arrow T. In both cases, the result of the displacement of the second flexible drive 2' with respect to the first flexible drive 1' in the respectively preferred direction is an improved entry behavior of flat work pieces which are fed to the apparatus, compared with a merely inclined configuration without corresponding displacement of the second flexible drive 2' with respect to the first flexible drive 1'.

In a preferred refinement, the first conveyor, which is in the form of the first flexible drive 1' here, can also be displaced in and counter to the transport direction according to arrow T.

In order to realize the displaceability, the first flexible drive 1' is disposed on a first carriage 8 and the second flexible drive 2' is disposed on a second carriage 9. In each case only one of two side cheeks 8.1 and 9.1 of the two carriages 8 and 9 can be seen in the figures. The carriages 8 and 9 are carried by side walls, of which in turn only one side wall denoted by 10 can be seen in the figures. The side walls 10 have slots 11 which are oriented in the transport direction and into which guide pins 12 engage which are provided on the carriages 8 and 9. In an alternative refinement, guide rollers, which are mounted on the carriages 8 and 9 so as to be rotatable are provided instead of the guide pins 12.

A gear wheel 13 is mounted rotatably in at least one of the side walls 10 between the two carriages 8 and 9. Teeth of a first rack toothing system 14 and a second rack toothing system 15 are provided on a respective one of the two carriages 8 and 9, which teeth follow one another in or counter to the transport direction according to arrow T and engage with the gear wheel 13. If one of the two carriages 8 and 9 is displaced in a first direction, this leads visibly to a simultaneous and identical displacement of the other carriage in a second direction opposite to the first direction. Here, the gear wheel 13 is an adjusting wheel, on which the first flexible drive 1' and the second flexible drive 2' roll simultaneously.

The two conveyors (in the form here of the first flexible drive 1' and the second flexible drive 2') can be locked in jointly assumed different pivoting positions, with respect to a geometric axis 16, which extends transversely with respect to the transport direction according to arrow T. The geometric axis 16 preferably lies in the conveying plane 3 which is situated between the two conveyors 1 and 2, and furthermore, preferably in the region of an inlet into a processing station which follows downstream of the apparatus and is shown as a press station 17 in the present exemplary embodiment.

In order to lock the two conveyors 1 and 2, which are configured here as flexible drives 1' and 2', in jointly assumed pivoting positions with regard to the above-mentioned geometric axis 16, at least one of the side walls is assigned a non-illustrated stationary support which has a plane-parallel region which is parallel to the side walls 10 and is penetrated by a slotted guide which is concentric with respect to the geometric axis 16 and of sufficient longitudinal extent. A projection 10.1 is provided on the at least one side wall 10 assigned to the support, which projection 10.1 reaches into the region of the slotted guide 18 when the conveyors 1 and 2 assume a defined working position, horizontally or inclined in one or the other direction. Disposed on the projection 10.1 of the at least one side wall 10 are, for example, pins 19 or else rotatably mounted rollers which engage into the slotted guide 18 in a defined working position of the conveyors 1 and 2 at a certain mutual spacing. The two conveyors 1 and 2 (in the form here of the flexible drives 1' and 2') can thus be set to common pivoting positions. In the present example, in order to lock them in one of these pivoting positions, a sufficient frictional fit is produced between the abovementioned support and the projection 10.1, such as, for example, by a screw connection 20, which presses the projection 10.1 and the above-mentioned support against one another.

For adaptation to different thicknesses of the flat work pieces 6, different spacings can be set between the two conveyors 1 and 2. In the present exemplary embodiment, in which the conveyors 1 and 2 are present in the form of the flexible drives 1' and 2', the spacings between the conveyors 1 and 2 are determined by the spacings of the conveying runs of the two flexible drives 1' and 2'. To this extent, the flexible drives 1' and 2' contain adjustably disposed flexible drive guide rollers which determine the mutual spacing of the conveying runs of the flexible drives 1' and 2', for adaptation to different thicknesses of the flat work pieces 6.

As provided in the present exemplary embodiment, it is sufficient if only the flexible drive guide rollers for guiding one of the two conveying runs are disposed adjustably. Accordingly, the flexible drive guide rollers 7.2 and the deflection rollers 4.4 of the second flexible drive 2', which likewise serve as flexible drive guide rollers are disposed adjustably.

For this purpose, a first pivoting shaft 22 and a second pivoting shaft 23 are mounted freely rotatably in the side cheeks 9.1 of the second carriage 9 and are preferably pinned in each of the two pivoting shaft end sections with in each case a two-armed bearing lever 21 which, on a first lever arm 21.1 of the same, mounts in each case one end of an axle 7 which carries the deflection and flexible drive guide rollers 4.4 or of an axle 7 which carries the flexible drive guide rollers 7.2.

Figure 4:
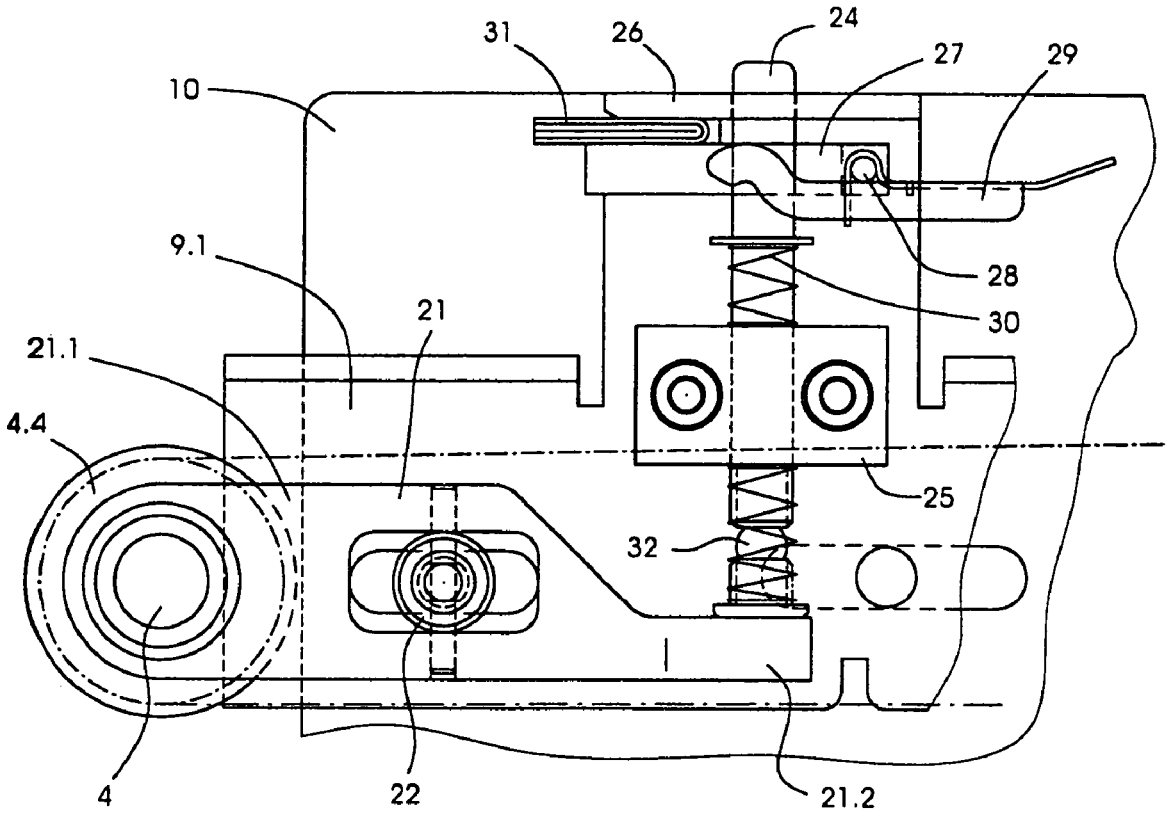
FIG. 4 is an illustration of a detail from FIG. 1 which has a configuration for adapting the apparatus to different thicknesses of the flat work pieces.
Figure 5:
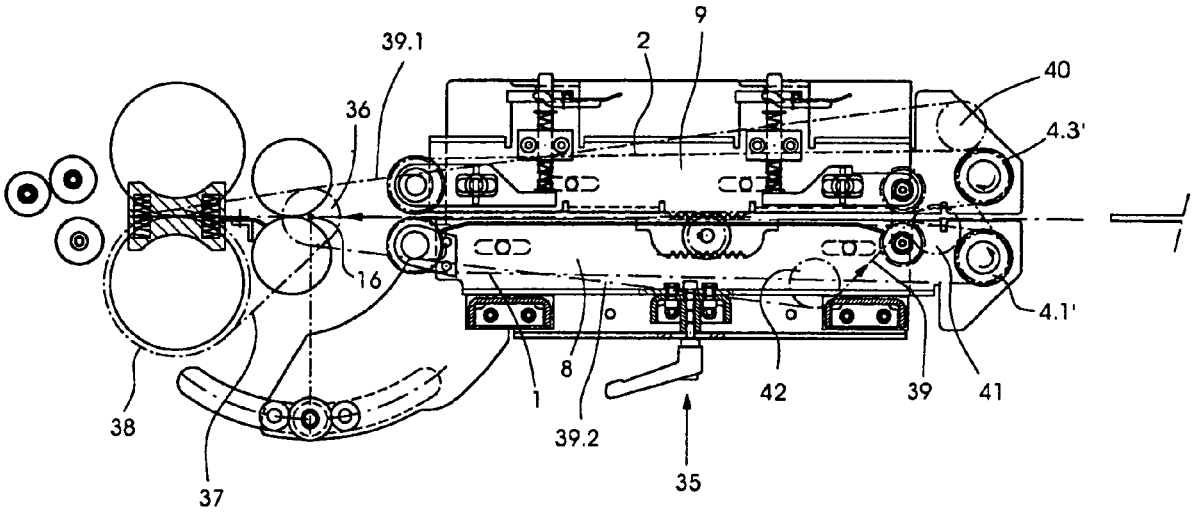
FIG. 5 is a diagrammatic, side-elevational view of the apparatus according to FIG. 1, in which a device for driving the apparatus and for locking the conveyors are emphasized in relative positions to one another.

As can also be gathered, in particular, from FIG. 4, in each case an adjustment pin 24 is set against the second lever arm 21.2 in such a way that, by exerting an adjusting force, it actuates the bearing lever 21 in terms of pivoting the first lever arm 21.1 away from the conveying plane 3, to be precise counter to the effect of a non-illustrated force accumulator which acts on the first lever arm 21.1, for example a compression spring.

The adjustment pin 24 is guided in a guide block 25 that is fastened to the side cheek 9.1 and is provided for the purpose with an appropriate hole, and in another appropriate hole in an angled-away bracket 26 of the side cheek 9.1. Fastened to an end section of the adjustment pin 24 that faces the bracket 26 is a clamping plate 27 that is oriented transversely with respect to the end section. The clamping plate 27 carries an axle 28, which is oriented perpendicularly with respect to the adjustment pin 24 and in relation to which a two-armed adjustment lever 29 can be pivoted. In the event of a corresponding pivoting of the adjustment lever 29 (in the clockwise direction in the case of the configuration according to FIG. 4), the latter presses the axle 28 and thus the clamping plate 27 away from the bracket 26 (counter to the action of a spring 30), with contact between an end (specially shaped at this location) of an arm of the adjustment lever 29 and the bracket 26, with the result that the adjustment pin 24 causes the bearing levers 21 which carry the axle 4 to pivot in the clockwise direction and the bearing levers 21 which carry the axle 7 to pivot in the counter-clockwise direction, the deflection and flexible drive guide rollers 4.4 and the flexible drive guide rollers 7.2 being removed from the conveying plane 4.

Using the adjustment device which have been explained to this extent for adapting the apparatus to different thicknesses of the flat work pieces 6, it is possible to perform a defined setting for a defined thickness in a very simple manner, in that a part is clamped into the gap which is produced by the adjustment lever 29 between the bracket 26 and the clamping plate 27, the part corresponding to the thickness of the flat work pieces. For this purpose, a part 31 of one of the flat work pieces 6 to be transported, which has been cut correspondingly to fit is preferably used.

For the optimum transmission of adjusting forces from the adjustment pin 24 onto the bearing lever 21, a ball 32 is disposed between the latter which is inserted into a respective spherical cap formed on the adjustment pin 24 and on the second lever arm 21.2 of the bearing lever 21.

To this extent, the bearing levers 21 which directly carry the deflection and flexible drive guide rollers 4.4 and the flexible drive guide rollers 7.2 are disposed so to be adjustable to different pivoting positions, and the deflection and flexible drive guide rollers 4.4 and the flexible drive guide rollers 7.2 are disposed so as to be adjustable, for adaptation to different thicknesses of the flat work pieces 6.

The upstream ends of the conveyors 1 and 2, which are configured in the form of the two flexible drives 1' and 2' in the present exemplary embodiment, form an inlet mouth 33 with a mouth upper part 33.1 and a mouth lower part 33.2, and their downstream ends form an outlet mouth 34 with a mouth upper part 34.1 and a mouth lower part 34.2.

As can be seen in FIG. 1, in the case of the apparatus being used with horizontally oriented conveyors, the mouth upper parts 33.1 and 34.1 are flush with the respectively associated mouth lower part 33.2 and 34.2. Given appropriate displacement of the conveyors 1 and 2, the respective mouth upper part 33.1 and 34.1 and/or the respective mouth lower part 33.2 and 34.2 can be displaced between positions in which first the mouth lower part 33.2 and 34.2 protrudes beyond the mouth upper part 33.1 and 34.1 and second the mouth upper part 33.1 and 34.1 protrudes beyond the mouth lower part 33.2 and 34.2.

To this extent, the geometry of the inlet mouth 33 (and also of the outlet mouth 34) can be optimized with regard to a respectively required pivoting position, caused by the outlet level in a processing station that precedes the apparatus.

FIG. 2 shows a first example of this. In this case, the outlet of the flat work pieces 6 from a preceding processing station lies at a lower level than the entry into a processing station that is connected behind the apparatus, in this case the press station 17. The conveyors 1 and 2 (the first flexible drive 1' and the second flexible drive 2' here) are locked for this purpose in a jointly assumed pivoting position, in which the conveyors 1 and 2 are pivoted downward with regard to the geometric axis 16 already explained. Here, the geometry of the inlet mouth 33 is optimized with regard to the pivoting position, to the extent that the mouth lower part 33.2 protrudes beyond the mouth upper part 33.1. In this configuration, flat work pieces 6 that are ejected from a preceding processing station at a lower level than that of the geometric axis 16, about which the conveyors 1 and 2 can be pivoted jointly, pass visibly unimpeded and as intended between the conveying runs of the two flexible drives 1' and 2'.

The result here for the outlet mouth 34 is that the mouth upper part 34.1 protrudes beyond the mouth lower part 34.2 and, apart from the inclined configuration of the conveyors 1 and 2, the transfer conditions from the latter to the following processing station which is configured as a press station 17 in the present example change only unsubstantially as a result of the displaced mutual position of the conveyors 1 and 2, to the extent that, in order to achieve a protrusion of the mouth lower part 33.2 of the inlet mouth 33 by a defined amount beyond its mouth upper part 33.1, in the preferred configuration for the positive displacement of both conveyors in opposite directions, the mouth upper part 34.1 and the mouth lower part 34.2 have to be displaced merely by half of the stated amount.

FIG. 3 shows a configuration for the case where a preceding processing station ejects flat work pieces 6 at a level, which is higher than the geometric axis 16.

As a consequence, the conveyors 1 and 2 are pivoted upward with regard to the geometric axis 16. This results in an optimized geometry of the inlet mouth 33 as a result of the two flexible drives 1' and 2 being displaced in such a way that the mouth upper part 33.1 of the inlet mouth 33 protrudes beyond its mouth lower part 33.2.

In this configuration, the work pieces 6 which are ejected from a preceding processing station at a level above that of the geometric axis 16 also pass visibly unimpeded and as intended between the two flexible drives 1' and 2'. What was stated in conjunction with FIG. 2 applies in the same way to the outlet mouth 34.

Compared with FIGS. 1 to 3, FIG. 5 is supplemented by details and to this extent exhibits a locking apparatus 35, by which the two carriages 8 and 9 which carry the flexible drives 1' and 2' can be locked in a respectively selected carriage position with respect to side walls 10 which carry them, and also exhibits drive devices for operating the flexible drives 1' and 2'.

The abovementioned drive devices contain a double belt pulley 36 which is disposed concentrically with respect to the geometric axis 16, is driven via an endless belt 37 by an operationally rotating wheel 38 of the downstream processing station configured here as a press station, and is wrapped around by a further endless belt 39. The latter forms an upper run 39.1 which, starting from the double pulley wheel 36, wraps around a deflection pulley 40 with its inner side, then wraps around a belt pulley 4.3' which drives the deflection rollers 4.3 with its outer side, then wraps around a belt pulley 4.1' which drives the deflection rollers 4.1 with its inner side, then wraps around a deflection pulley 41 with its outside, and then wraps around a further deflection pulley 42 with the inner side, from which deflection pulley 42 a lower run 39.2 of the belt 39 runs back to the double belt pulley 36. The belt drive, which is preferably configured in this manner is preferably a toothed belt drive with endless toothed belts with toothing on the inner side and outer side.

Here, the double belt pulley 36 circulates in the counterclockwise direction.

In the exemplary embodiment explained to this extent, although the conveyors 1 and 2 are configured as flexible drives 1' and 2', the conveying runs of which moreover extend along the entire transport path, the scope of the invention also includes conveyors which are configured differently than this, such as flexible drives having in each case more than one conveying run extending along the transport path, or as roller conveyors or as combinations of conveyors which are configured from at least one roller conveying path and at least one flexible drive conveyor.

This application claims the priority, under 35 U.S.C. § 119, of German patent application No. 10 2004 015 592.5, filed Mar. 30, 2004; the entire disclosure of the prior application is herewith incorporated by reference.

We claim:

1. An apparatus for transporting flat work pieces in a transport direction, the apparatus comprising:

a first conveyor for making contact with a first surface of a respective one of the work pieces; and a second conveyor for making contact with a second surface, lying opposite the first surface, of the respective one of the work pieces;

said first and second conveyors forming an inlet mouth having a mouth upper part and a mouth lower part, said inlet mouth having a geometry which can be changed such that, in a first case, said mouth lower part protrudes beyond said mouth upper part and, in a second case, said mouth upper part protrudes beyond said mouth lower part;

said first conveyor being displaceable in a first direction and, at the same time, said second conveyor being displaceable into an opposite second direction.

2. The apparatus according to claim 1, further comprising an adjusting wheel on which said first and second conveyors roll simultaneously when the said first and second conveyors are displaced.

3. The apparatus according to claim 1, wherein said first and second conveyors can be locked in jointly assumed different pivoting positions, with regard to a geometric axis which Extends transversely with respect to the transport direction.

4. The apparatus according to claim 3, wherein the geometric axis lies in a conveying plane which is situated between said first and second conveyors.

5. The apparatus according to claim 1, wherein for adaptation to different thicknesses of the flat work pieces, different spacings between said first and second conveyors can be set.

6. The apparatus according to claim 1, wherein said first and second conveyors have a first and a second flexible drive, respectively.

7. The apparatus according to claim 6, wherein for adaptation to different thicknesses of the flat work pieces, said first and second flexible drives contain adjustably disposed flexible drive guide rollers.

8. The apparatus according to claim 7, further comprising bearing levers carrying said flexible drive guide rollers and can be set to different pivoting positions.

9. The apparatus according to claim 1, wherein in a third case, said mouth upper part and said mouth lower part of said inlet mouth are flush with one another.

* * * * *